US007415737B2

(12) United States Patent
Hung et al.

(10) Patent No.: US 7,415,737 B2
(45) Date of Patent: Aug. 26, 2008

(54) AUTOMATIC FLUSHER FOR TANK-TYPE TOILET

(76) Inventors: Raymond Yinghui Hung, 21422 Running Branch Rd., Diamond Bar, CA (US) 91765; Mark Y. F. Chow, 1410 San Marino Ave., San Marino, CA (US) 91108

( * ) Notice: Subject to any disclaimer, the term of this patent is extended or adjusted under 35 U.S.C. 154(b) by 384 days.

(21) Appl. No.: 11/075,696

(22) Filed: Mar. 10, 2005

(65) Prior Publication Data

US 2005/0217014 A1 Oct. 6, 2005

(51) Int. Cl.
*E03D 5/00* (2006.01)

(52) U.S. Cl. ..... 4/405; 4/406; 4/302

(58) Field of Classification Search ..... 4/405, 4/406, 302–305, 313, 314
See application file for complete search history.

(56) References Cited

U.S. PATENT DOCUMENTS

| | | | | |
|---|---|---|---|---|
| 4,916,762 | A * | 4/1990 | Shaw | 4/415 |
| 6,618,864 | B2 * | 9/2003 | Veal | 4/313 |
| 7,028,347 | B2 * | 4/2006 | Sanderson | 4/313 |
| 7,140,050 | B2 * | 11/2006 | Muderlak | 4/313 |

* cited by examiner

*Primary Examiner*—Khoa D Huynh
(74) *Attorney, Agent, or Firm*—Rosenberg, Klein & Lee

(57) ABSTRACT

An automatic flushing system is equipped with a buoyancy mechanism to unseat a valve set in a tank of a toilet. The automatic flushing system, equipped with battery power, includes sets of sensing, actuating, latching, buoyancy, unseat/seat and valve members. The battery power only provides electrical power to sensing and actuating members to release a float from an engaged position to a release position. Thus, the buoyancy of the float may unseat a valve to open a drain of the tank.

11 Claims, 7 Drawing Sheets

AUTOMATIC FLUSHER FOR TANK-TYPE TOILET

BACKGROUND OF THE INVENTION

1. Field of the Invention

The present invention relates generally to a flushing system for tank-type toilets and, more particularly to an automatic flushing system with buoyancy-actuating means to actuate flush valve.

2. Discussion of the Related Art

U.S. Pat. Nos. 5,169,118 and 5,244,179 relates to an automatic operated toilet room flush valve, wherein a solenoid operated automatic flush valve, which is battery-operated and utilizes a latching solenoid to limit power drain on the battery. Accordingly, when the infrared sensor detects the presence of a user of a toilet, the flush valve is automatically driven to open to complete the flushing operation.

U.S. Pat. No. 5,054,132 relates to a flush control system for a plumbing fixture having electrical components that electrically operate a flush valve, wherein an electrical circuit is activated to lift a normally closed cover for a predetermined time. When the cover is subsequently lowered, the flush valve is actuated for a second predetermined time. U.S. Pat. No. 3,590,397 relates to an automatic flushing device for a toilet, wherein the flushing of water is controlled by a switch actuated by a lid, such that, when the lid is opened, a control circuit opens a flush valve for a predetermined period of time to flush the toilet prior to use, and when the lid is closed after use, the control circuit again opens the valve for a predetermined period of time to flush the toilet again. U.S. Pat. No. 2,200,687 relates to a toilet bowl in which the seat and cover members may be automatically closed under predetermined conditions after being shifted to a raised position, and in which a mechanism is incorporated for coactions with one of the seat and cover members as it is moved to a closed position for actuating the flushing valve of the toilet. U.S. Pat. No. 1,313,740 relates to a manually operated mechanism for raising the cover of a toilet bowl and for lowering the cover and flushing the bowl, the mechanism including a pivotally mounted and manually operated lever which is connected, through the medium of a bar, to the cover, which lever engages and idly operates a pivoted pawl upon the raising action of the cover, and strikes and operates the pawl in a movement which lowers the cover for operating the flushing mechanism to flush the bowl simultaneously with the lowering of the cover.

U.S. Pat. No. 1,287,113 relates to a toilet flushing mechanism that includes a longitudinally movable bar that is connected to a pivoted cover or seat of a toilet bowl, and a plurality of pawls and levers that are controlled by the depressions of foot rods for moving the bar longitudinally to move the pivoted seat and also to operate the flushing mechanism of the toilet at the time when the seat is started to be moved into a closed position.

All other prior arts related to toilet flushing automation require alterations to existing flush mechanism of the existing toilet to achieve the purpose of control, the present invention retrofits with existing tank-type toilet and works with existing manual flush mechanism. No structure alteration is required for existing tank toilet.

In addition, all other flush actuation prior arts did not consider utilizing the natural resource, buoyancy, to actuate flush valve, hence automation for such a actuation device requires more power or energy; battery application is impractical, either require larger size of battery and motor or require power from A/C power supply; furthermore, the life cycles of batteries were dramatically shorter and require significant more cost of maintenance.

Neither of these systems previously proposed, however, combine the desirable characteristics of being economical, durable, simple to operate and install by user.

SUMMARY OF THE INVENTION

An automatic buoyancy flusher for tank-type toilet is disclosed to drain water from tank with the help of buoyancy on a float. Once the float, coupled with a driving lever, begins to buoy itself up from beneath the water level in the tank, a flapper valve, loosely linked with a driven lever and covering a flushing exit, moves from a seated to unseated position to drain water out.

Furthermore, one of objects of the present invention is to provide a battery-powered, micro-controller based automatic flushing system. A battery-powered motor drive is employed to release the engaged float that would unseat the valve with the buoyancy thereof.

Furthermore, another one of objects of the present invention is to provide an automatic flushing system for tank-type toilet. Upon a valid actuation signal from the activating sensor, a micro-controller based circuit activates latch-releasing mechanism, and releases the upward latch of the actuating lever. The float, which coupled with the actuating lever, starts to move upwardly by buoyancy, and causes the driven end of the actuating lever to lift the flapper to flush.

Furthermore, the present invention utilizes buoyancy as driving force to actuate toilet flush process. A simple mechanical structure, which is electronic controllable and providing mechanical advantages, is also adapted to the present invention.

In accordance with the present invention, the automatic buoyancy flusher for tank-type toilet, provides an economical, reliable and energy saving means of toilet flushing automation. The energy requires to actuate toilet flush has been greatly reduced. Hence, tank-type toilet flushing automation by battery power becomes applicable. An automatic flushing system adapted to be installed within a tank of a toilet includes: sensing means for detecting the toilet usage, generating and sending an actuating signal; driving means for receiving the actuating signal to actuate a latching means; the latching means for engaging and releasing a buoyancy means; the buoyancy means for applying buoyancy of water in the tank to an actuating means; the actuating means for unseating and seating a valve means with the help of the buoyancy means; and the valve means adapted to a drain of the tank to open or close the drain with the help of the actuating means.

Additional objectives, advantages, and features of the present invention will become apparent from the following description and appended claims, taken in conjunction with the accompanying drawings.

DETAILED DESCRIPTION OF THE INVENTION

The following description is of the best presently contemplated mode of carrying out the present invention. This description is not to be taken in a limiting sense but is made merely for the purpose of describing the general principles of the invention. The scope of the invention should be determined by referencing the appended claims.

Figure 1:
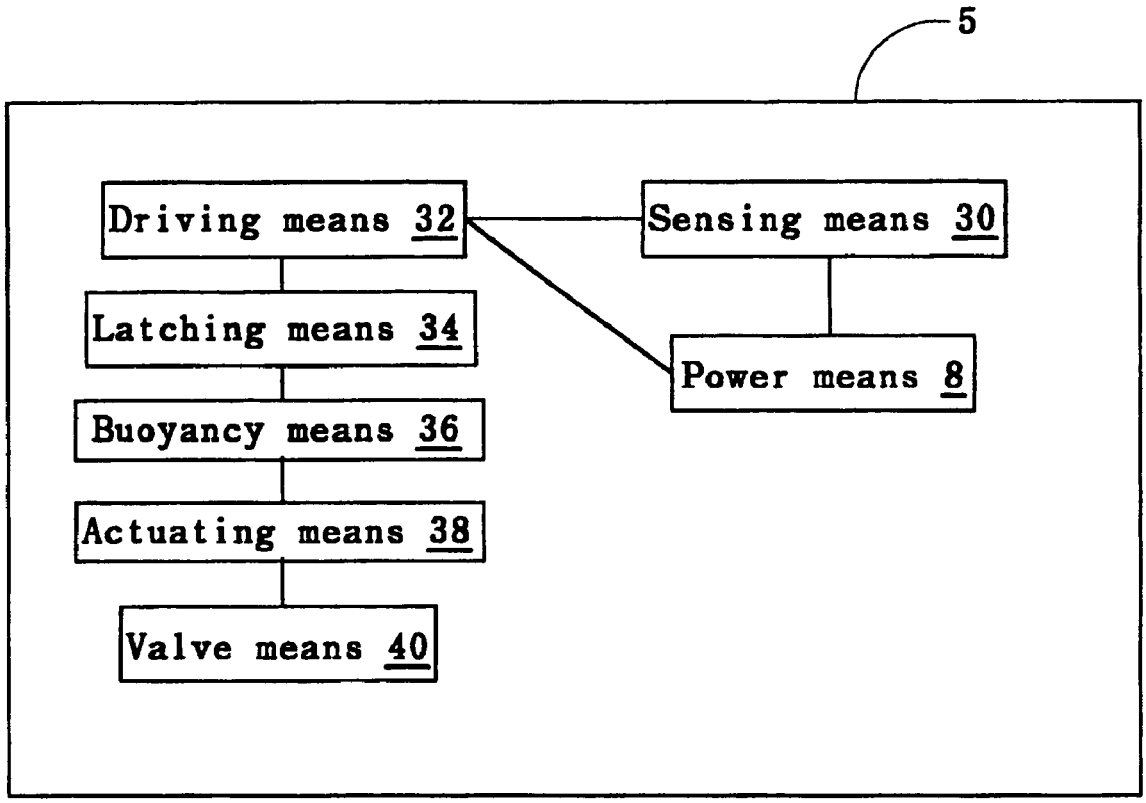
FIG. 1 is a schematically block diagram illustrating the automatic flushing system in accordance with the present invention.

FIG. 1 is a schematically block diagram illustrating the automatic flushing system in accordance with one of embodiments of the present invention. In the embodiment, the automatic flushing system 5 includes a power means 8, a sensing means 30, a driving means 32, a latching means 34, a buoyancy means 36, an actuating means 38 and a valve means 40. Instead of directly lifting or ascending the valve means 40, The power means 8, such as one or a set of batteries and associated circuit, provides the automatic flushing system 5 with enough power to release latch means 34 for starting a flush cycle of a tank-type toilet. The sensing means 30, not limited to, including a battery-operated, wired or wireless, radio frequency base sensor, infrared, ultrasonic or light sensitive detectors adapted mounted outside of the flush tank and wired or wireless, such as radio frequency transmitter, electrically connects the power means 8 and may detect the command of starting the flushing cycle. Alternatively, the sensing means 30 may be installed anywhere within the range of low power wireless, such as radio frequency, or wired transmitter.

Furthermore, the driving means 32 may be ready to initiate the latching means 34 according to the signal from the sensing means 30. In one embodiment, the driving means 32 may include micro-controller circuit, a set of motor, switches and gears to connect the latching means 34, but not limited to. Alternatively, the driving means 32 may be in combination with the latching means 34. Furthermore, the power means 8 may provide the driving means 32 with electrical power. The latching means 34 may connect the driving means 32 and be ready to start the flushing cycle by releasing the buoyancy means 36. In one embodiment, the latching means 34 may include a set of levers and gears, but not limited to. Alternatively, the latching means 34 may be in combination with the driving means 32.

Next, the buoyancy means 36 may be subjected to water in the flush tank 10 at different levels and interact with the latching means 34. In one embodiment, the buoyancy means 36 may include a set of float, water level sensor, levers and gears (shown in the following drawings in detail), but not limited to. It is noted that the buoyancy means 36 may actuate, while sufficient water level is detected, the actuating means 38, and the actuating means 38 may further unseat or seat the valve means 40 with the help of the buoyancy means 36. In one embodiment, the actuating means 38 may include a set of levers and jointer, but not limited to. Alternatively, the actuating means 38 may be in combination with the latching means 34. The valve means 40, adapted the drain in the flush tank 10, may response the actuating means 38 to open or cover the drain. In one embodiment, the valve means 40 may include a flapper or a valve, but not limited. Alternatively, the valve means 40 may connect any conventional manual flushing mechanism to response a manual command.

Figure 2A:
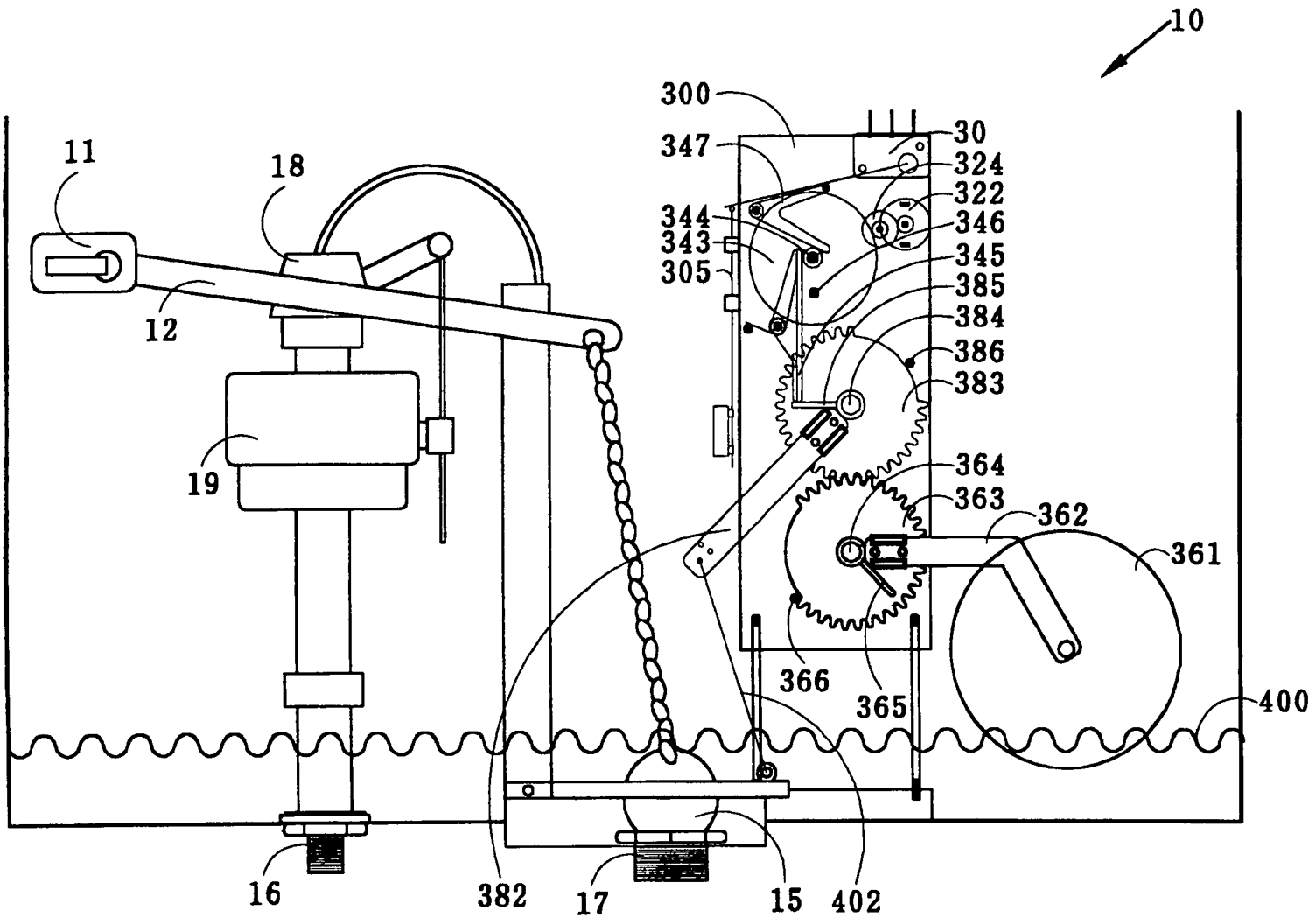
FIG. 2A is a fragmentary sectional view showing the positions of members in the automatic flushing system when water is at its low level in the tank in accordance with one embodiment of the present invention.

Referring to FIG. 2A, an automatic flushing system 5 is in combination with a manual flushing mechanism in a conventional flush tank (not shown). A water supply inlet 16 connects to outside water system (not shown), with a control valve 18 and a float member 19. A flapper valve 15, one component of the valve means 40, is also disposed in the flush tank. When the flapper valve 15 is operated, allows the quantity of water stored in the flush tank to be delivered by gravity flow through outlet 17 to the toilet bowl for flushing the toilet. Once the water level 400 in the tank drop to a low level, the flapper valve 15 returns to its close position automatically, to prevent further flow of the water, and the water supply inlet 16 starts replenishing water to sufficient water level (high level). A tripping handle 11 operates flush lever 12 for the manual flush. The automatic flushing system 5 is incorporated in the flush tank, no interference between present invention and existing components.

Furthermore, the buoyancy means 36 may include a set of float 361, water level sensor 305, levers 362, 382, gears 363, 383, but not limited to. When the automatic flushing system 5 is at a reset condition, the float 361, which is fixed on one end of the lever 362 for guiding upward movement, is at its engaged position. The other end of the lever 362 is deposited on the gear 363. The gear 363 limitedly pivotally moves on a shaft 364 at its center and a stop plate 365 is extruded from the shaft 364. A stop shaft 366 is adapted to restrict the movement of the gear 363. For the actuating means 38 of the automatic flushing system 5 at a reset condition, the gear 383 shared with the buoyancy means 36, fixed by a shaft 384, is adapted to engage with the gear 363. Another latch shaft 385 is extruded from the shaft 384 to restrict the movement of the lever 382 shared with the buoyancy means 36. One end of the lever 382 joints the flapper valve 15 through any suitable connection, such as a jointing chain 402. In the embodiment, the lever 382 at its engaged position seats the flapper valve 15. With the help of the operation of the buoyancy means 36, the operation of the actuating means 38 may unseat or seat the flapper valve 15. Optionally, the lever 382 would be equipped with another float (not shown), as well as the float 361, of help to unseating the flapper valve 15.

Alternatively, Referring to FIG. 2A, for the consideration of enclosed space or volume of the flush tank, the joint chain 402 may be directly coupled to the lever 362 instead of the lever 382. That is, the lever 382 would be integrated with the lever 362 for a compact arrangement. As well as the lever 382, the gear 383 with its related components would be integrated with the gear 363.

The latching means 34 may include a pivotal member 343 pivotally moving on a shaft 344 at its center, a latch lever 345 adapted to move between the shaft 344 and the latch shaft 385. The latch lever 345 may hold the driving end of the latch shaft 385 to hold the float 361 against its buoyancy. Another stop shaft 346 is arranged in an offset position to the shaft 344 on the pivotal member 343 to move the latch lever 345 when the pivotal member 343 pivots. Another latch lever 347 may be deposited near the pivotal member 343 and moved by the stop shaft 346 when the pivotal member 343 pivots. When in reset condition, the latch levers 347 and 345 near or attach to the shaft 344. The driving means 32 may include micro-controller circuit (not shown) and two rotary members 322 and 324. The rotary member 324 joints the rotary member 322 and the pivotal member 343 to adjust the movements of the rotary member 322 and the pivotal member 343. In the embodiment, the rotary member 322 may have a receiver (i.e. micro-controller circuit, not shown) to receive the signal of the sensing means 30 and further be driven to pivot. The sensing means 30 may sense or detect water level with a level 305 to emit the command. All components aforementioned may be deposited on a housing 300 in the tank 10.

Figure 2B:
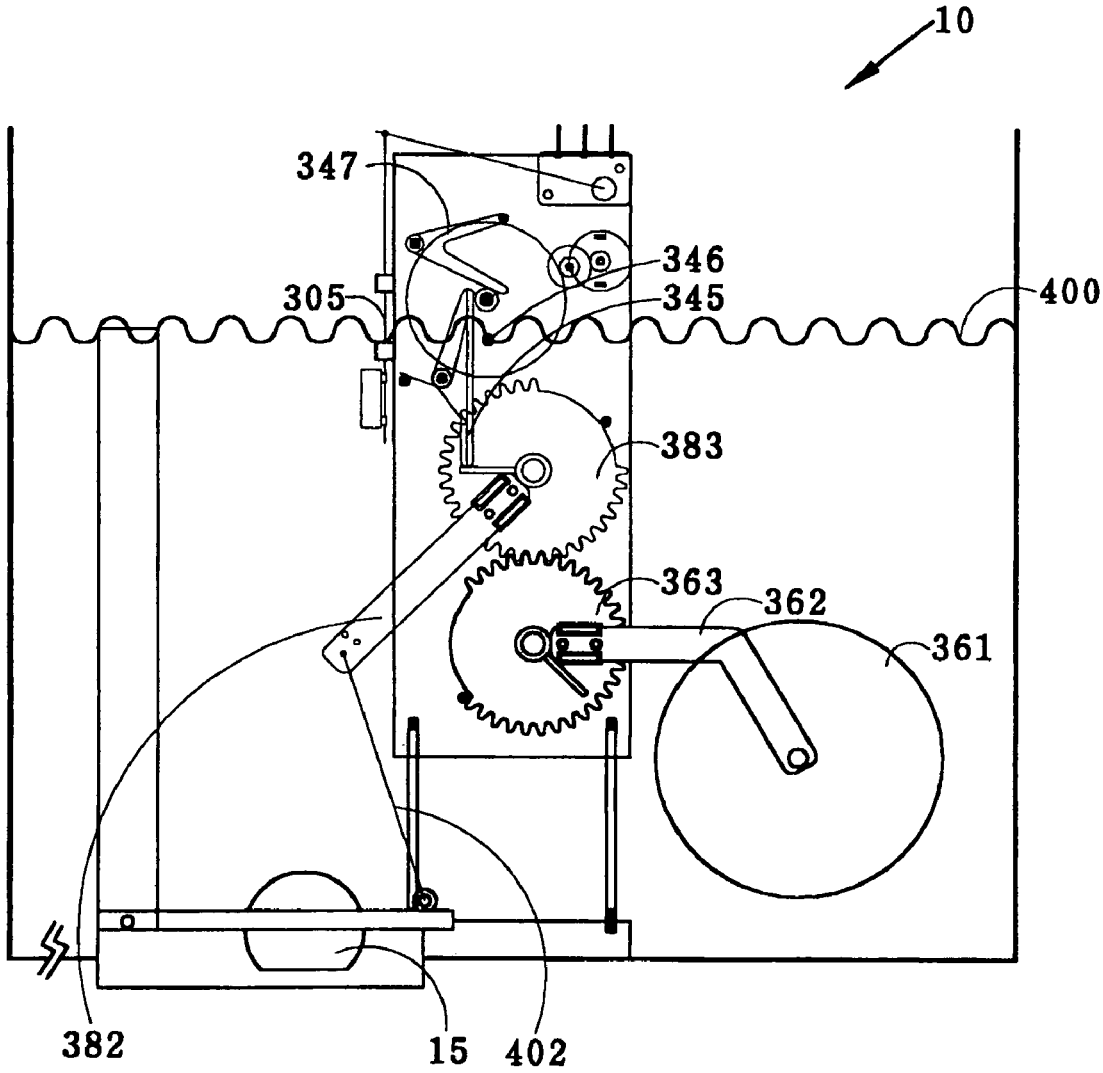
FIG. 2B is a fragmentary sectional view showing the positions of members in the automatic flushing system when water is replenished in accordance with one embodiment of the present invention.
Figure 2C:
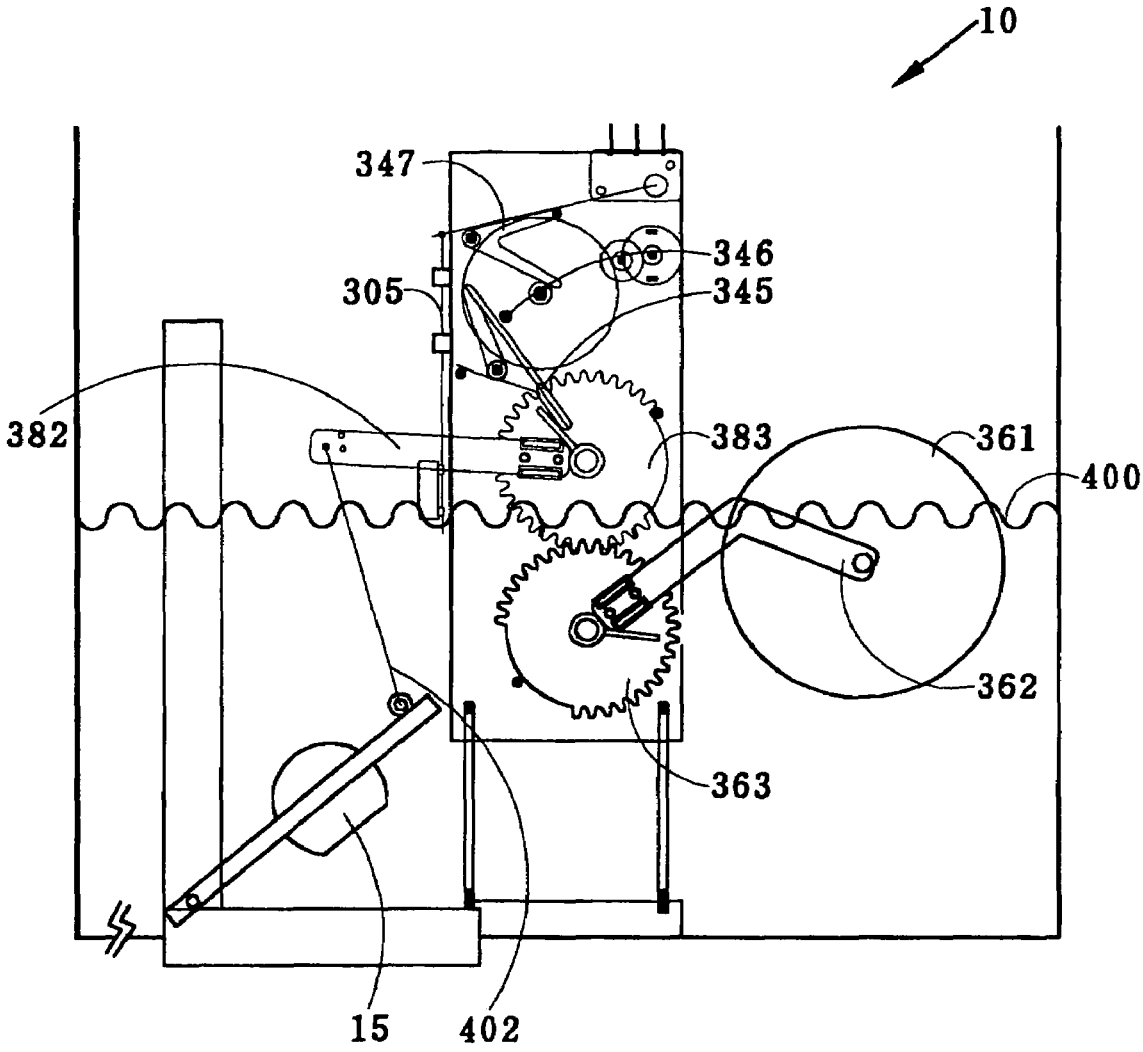
FIG. 2C is a fragmentary sectional view showing the positions of members in the automatic flushing system when the automatic flushing system actuates in accordance with one embodiment of the present invention.

Referring to FIG. 2B, while water level 400 in the flush tank 10 is at its refill level detected or marked by the level 305, the automatic flushing system 5 is standby for one flushing cycle. At the time, the float 361, the gear 363, the latch shaft 385 are at their engaged positions, respectively. Next, referring to FIG. 2C, the sensing means 30 detects the requirement of automatic flushing and emits the command, followed by the rotary member 322 being driven by the power means and the micro-controller circuit (not shown). The pivotal member 343 starts to rotate with the movement of the rotary member 322. The stop shaft 346 on the pivotal member 343 urges the latch lever 345 away from the shaft 344 to actuate the latch lever 345 at its released position. The latch shaft 385 is also at its released position and the gears 383 and 363 are released to be movable. At the time, the float 22 starts moving from its engaged position (under the water) to its released position (near the surface of the water in the flush tank). The movement by buoyancy generates force applying to the rotations of the gears 383 and 363. Thus, the lever 382 is lifted to unseat the valve 15 from its close position to its open position, and water starts flow through outlet.

Figure 2D:
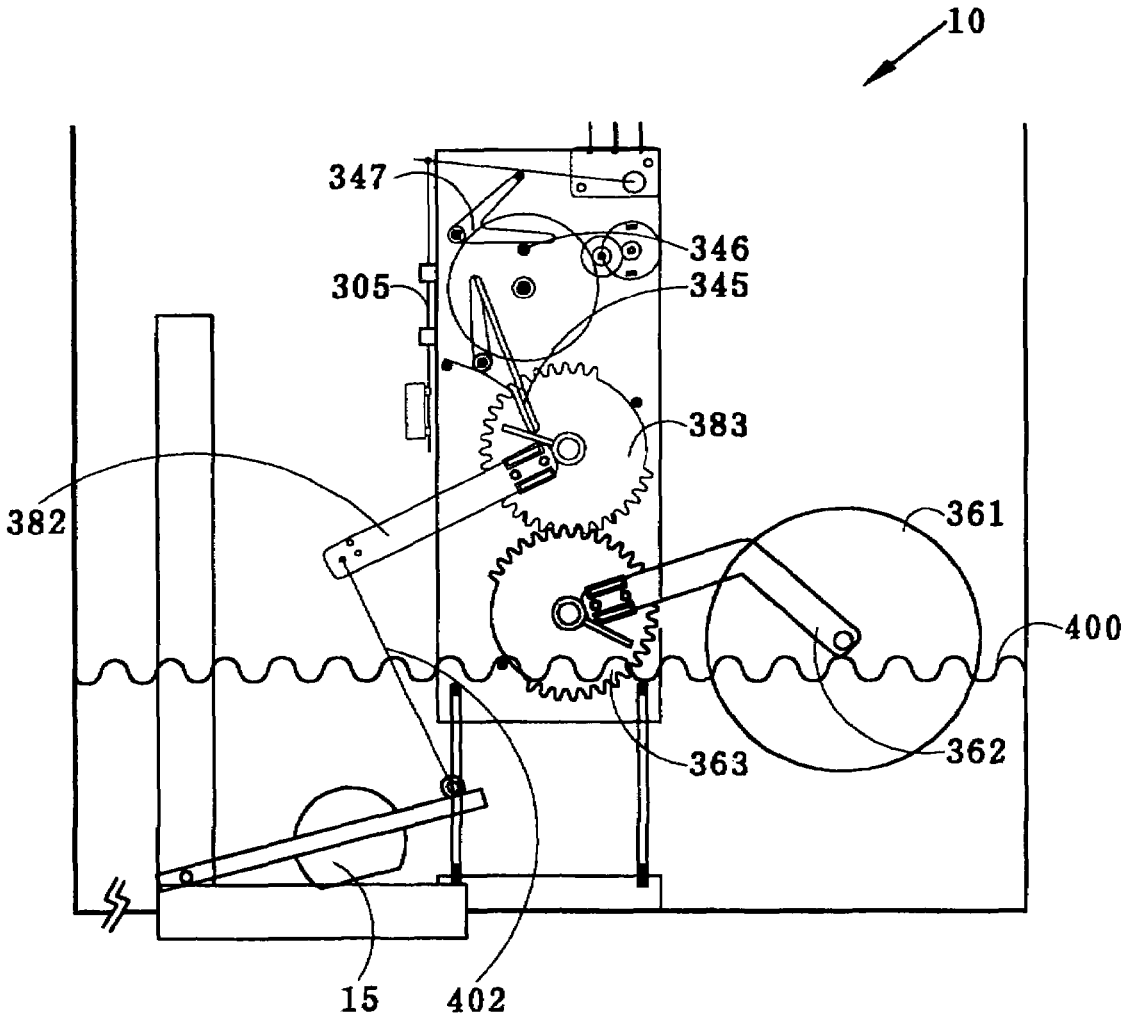
FIG. 2D is a fragmentary sectional view showing the positions of members in the automatic flushing system when water drains out of a tank in accordance with one embodiment of the present invention.

Referring to FIG. 2D, once the water level 400 in the flush tank falls to the low level, the flapper valve 15 returns to it close position (is seated) by gravity automatically. At the time, the latch shaft 385 returns to its engaged position and starts latching with the latch lever 345. While water in the flush tank starts replenishing, the float 361 becomes submerging in the water, the latch lever 345 and the latch shaft 385 become fully engaged in the position that holds the float 361 against its buoyancy.

When the flapper valve 15 is in the close position, according to basic physics laws, the pressure force applies to the flapper valve 15 for preventing water flow through the outlet is:

Pressure Force=the weigh of water directly above the flapper valve

In order to lift a flapper to open position 56, a force greater than the pressure force is required.

Also, according to Archimedes' Principle "The buoyancy force on any object is equal to the weight of the liquid displaced by the object." Thus, in the embodiment, in order to lift the flapper valve 15, the buoyancy float 361 of present invention is designed to provide sufficient buoyancy force to compensate most of tank toilets. Optional supplemental float can be equipped with actuating lever for further increase buoyancy driving force.

Figure 3:
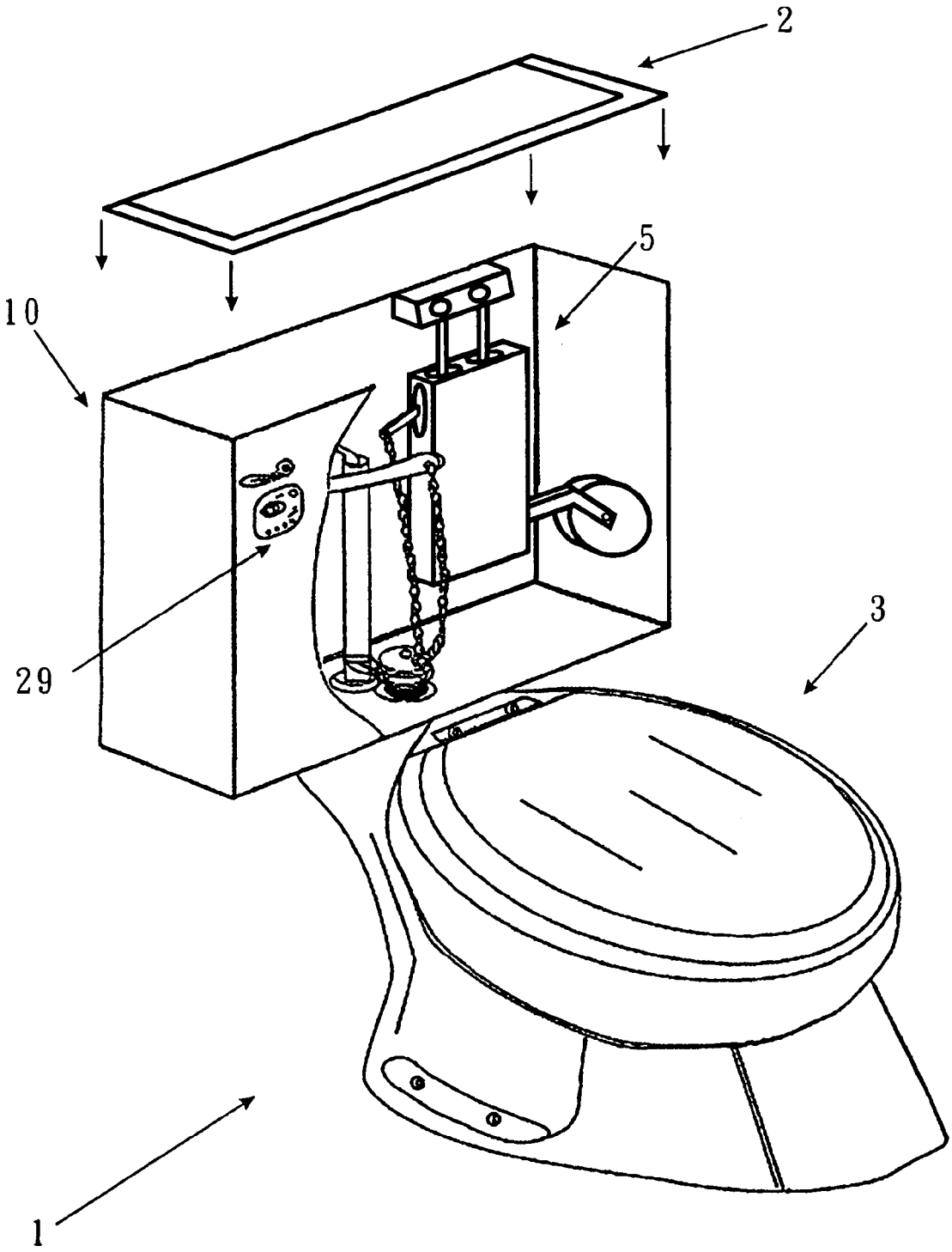
FIG. 3 is a perspective view of a standard flush tank with the automatic flushing system installed in accordance with one embodiment of the present invention.

Referring to FIG. 3, an automatic flushing system 5 is capable of incorporating or in combination with a manual flushing mechanism in a conventional flush tank 10 to achieve both manual and automatic operations to start one flushing cycle of a tank-type toilet system 1. In one embodiment, the tank-type toilet system 1, such as a typical tank-type, gravity flow toilet system, includes flush tank 10 with a cap 2 and a bowl 3, but not limited to. In the embodiment, the flush tank 10 stores a quantity of water for flushing the toilet. The automatic flushing system 5 is directly mounted on the wall of the flush tank 10 or affixed on the bottom of the wall, but not limited. An activating sensor 29 of a component of the sensing means 30 may be mounted outside of the flush tank 10. It is noted that the activating sensor 29 may be also equipped with at least one of sensing devices, wired or wireless, such as infrared, ultrasonic or light sensitive detectors, but not limited to.

Figure 4:
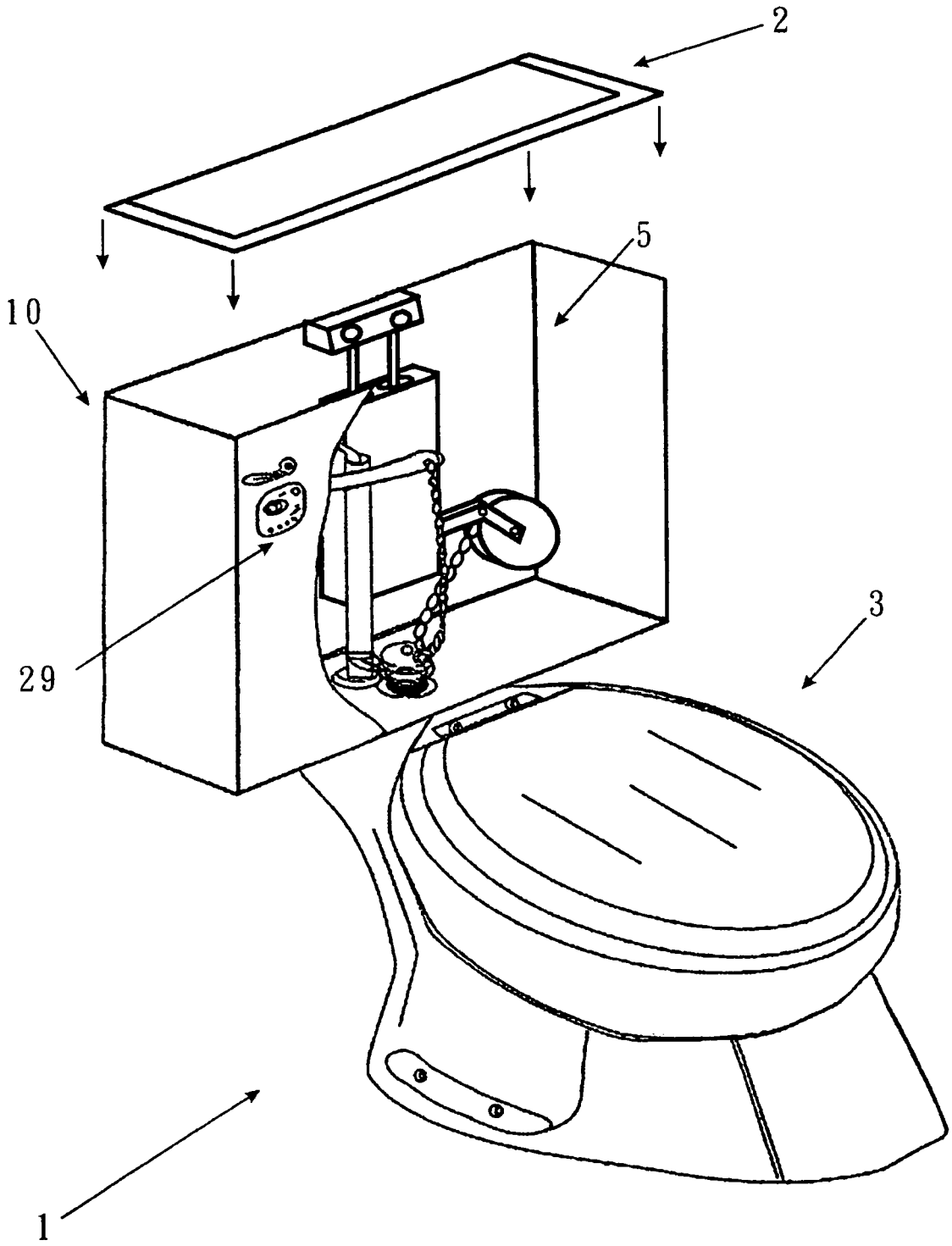
FIG. 4 is a perspective view of a standard flush tank with the automatic flushing system installed in accordance with another one embodiment of the present invention.

Referring to FIG. 4 is another embodiment of the present invention. Different from the system in FIG. 3, for the consideration of enclosed space or volume of the flush tank, the joint chain (402 with respect to FIG. 2A) may be directly coupled to the lever (362 with respect to FIG. 2A) instead of the lever (382 with respect to FIG. 2A). That is, the lever (382 with respect to FIG. 2A) would be integrated with the lever (362 with respect to FIG. 2A) for a compact arrangement. As well as the lever (382 with respect to FIG. 2A), the gear (383 with respect to FIG. 2A) with its related components would be integrated with the gear (363 with respect to FIG. 2A).

The foregoing description conveys the best understanding of the objectives and advantages of the present invention. Different embodiments may be made of the inventive concept and spirit of this invention. It is to be understood that all matter disclosed herein is to be interpreted merely as illustrative, and not in a limiting sense.

What is claimed is:

1. An automatic flushing system, adapted to be installed within a tank of a toilet, the automatic flushing system comprising:

sensing means for detecting the toilet usage, generating and sending an actuating signal;

driving means for receiving said actuating signal to actuate a latching means;

said latching means for engaging and releasing a buoyancy means;

said buoyancy means for applying buoyancy of water in the tank to an actuating means, wherein said buoyancy means comprises a float;

said actuating means for unseating and seating a valve means with the help of said buoyancy means; and said valve means adapted to a drain of the tank so as to open the drain by said actuating means, wherein said latching means releases said float, the force for opening of said drain of the tank is solely provided by the buoyancy force of said float.

2. The automatic flushing system of claim 1, further comprising a battery-power means for providing said sensing means and said driving means with electric power.

3. The automatic flushing system of claim 1, wherein said sensing means comprises a battery-operated wireless or wired sensor.

4. The automatic flushing system of claim 3, wherein said sensing means further comprises a transmitter for sending said actuating signal.

5. The automatic flushing system of claim 1, wherein said driving means comprises a micro-controller circuit, a set of rotary members and receivers to receive said actuating signal for driving movement of said latching means.

6. The automatic flushing system of claim 1, wherein said latching means comprises:

a pivotal member adapted to pivot on a central shaft;

a stop shaft fixed on said pivotal member and arranged in an offset position to said central shaft on said pivotal member; and a latch lever adapted to be urged away from said central shaft by said stop shaft when said pivotal member is driven to pivot and said stop shaft attaches to said latch lever.

7. The automatic flushing system of claim 6, wherein said buoyancy means further comprises:

a first gear pivotally fixed in the tank, said first gear adapted to pivot when said latch lever is at a release position away from said central shaft; and a guiding member fixed on said first gear and used as joint said float, wherein said float emerges out of water when said latch lever is at said release position.

8. The automatic flushing system of claim 7, wherein said actuating means comprises:

a second gear pivotally fixed in the tank, said second gear adapted to engage said first gear and pivot when said latch lever is at said release position;

a jointer to connect said valve means; and a member pivotally fixed on said second gear and unseats said valve means when said latch lever is at said release position.

9. The automatic flushing system of claim 1, wherein said valve means comprises a valve deposited on a drain of the tank.

10. The automatic flushing system of claim 1, wherein said buoyancy means is further configured for applying buoyancy of water in the tank to said valve means.

11. An automatic flushing system, adapted to be installed within a tank of a toilet, the automatic flushing system comprising:

sensing means for detecting the toilet usage, generating and sending an actuating signal;

a set of rotary members and receivers for receiving said actuating signal to actuate a pivotal member; said pivotal member adapted to pivot on a central shaft;

a stop shaft fixed on said pivotal member and arranged in an offset position to said central shaft on said pivotal member;

a latch lever adapted to be urged away from said central shaft by said stop shaft when said pivotal member is driven to pivot and said stop shaft attaches to said latch lever;

a first gear pivotally fixed in the tank, said first gear adapted to pivot when said latch lever is at a release position away from said central shaft;

a float;

a guiding member fixed on said first gear and used as joint said float, wherein said float emerges out of water when said latch lever is at said release position;

a second gear pivotally fixed in the tank, said second gear adapted to engage said first gear and pivot when said latch lever is at said release position;

a jointer to connect said valve means;

a member pivotally fixed on said second gear and unseats said valve means when said latch lever is at said release position;

said valve means adapted to a drain of the tank so as to open the drain by said actuating means, wherein the force for opening of said drain of the tank is solely provided by the buoyancy force of said float; and a battery-power set to provide said sensing means and said pivotal member with electric power.

* * * * *